US006589076B1

(12) United States Patent
Davis et al.

(10) Patent No.: US 6,589,076 B1
(45) Date of Patent: Jul. 8, 2003

(54) COMPUTER CABLE CONNECTOR PROVIDING QUICK ASSEMBLY AND REMOVAL

(75) Inventors: David R. Davis, Sioux City, IA (US); Jorge A. Moriel, El Paso, TX (US); Vernon D. Erickson, Dakota Dunes, SD (US); Jeff P. Thompson, Sioux City, IA (US)

(73) Assignee: Gateway, Inc., Poway, CA (US)

( * ) Notice: Subject to any disclaimer, the term of this patent is extended or adjusted under 35 U.S.C. 154(b) by 0 days.

(21) Appl. No.: 09/850,516

(22) Filed: May 7, 2001

(51) Int. Cl.[7] ..... H01R 13/60; H01R 13/66
(52) U.S. Cl. ..... 439/557; 439/939
(58) Field of Search ..... 439/552, 553, 439/557, 565, 358, 939

(56) References Cited

U.S. PATENT DOCUMENTS

| | | | | | |
|---|---|---|---|---|---|
| 3,337,836 | A | * | 8/1967 | Churla, Jr. | 439/557 |
| 4,867,707 | A | * | 9/1989 | Widdoes | 439/675 |
| 5,277,627 | A | * | 1/1994 | Matsuzaki | 439/677 |
| 5,382,177 | A | * | 1/1995 | Hutchinson et al. | 439/358 |
| 5,486,117 | A | * | 1/1996 | Chang | 439/357 |
| 5,525,074 | A | * | 6/1996 | Tsuji et al. | 439/555 |
| 5,637,015 | A | | 6/1997 | Tan et al. | |
| 5,727,963 | A | * | 3/1998 | LeMaster | 439/358 |
| 5,749,746 | A | | 5/1998 | Tan et al. | |
| 5,797,771 | A | * | 8/1998 | Garside | 439/610 |
| 5,810,614 | A | * | 9/1998 | Ruch | 439/247 |
| 5,876,246 | A | * | 3/1999 | Martin et al. | 439/557 |
| 5,941,725 | A | | 8/1999 | Brennan et al. | 439/357 |
| 5,975,957 | A | | 11/1999 | Noda et al. | 439/609 |
| 5,975,958 | A | | 11/1999 | Weidler | 439/620 |
| 6,010,354 | A | | 1/2000 | Cunningham | 439/417 |
| D449,276 | S | * | 10/2001 | Hwang et al. | D13/147 |
| 6,305,986 | B1 | * | 10/2001 | Hwang | 439/610 |
| 6,343,948 | B1 | * | 2/2002 | Nutzel | 439/358 |

OTHER PUBLICATIONS

"AMP Connector System for Universal Serial Bus", AMP website: http://connect.amp.com/AMP/bin/AMP.Conn . . . , 4 pages, (Mar. 29, 2000).

"General Information—Connector System for IEEE 1394 Serial Bus", AMP website: http://connect.amp.com/AMP/bin/AMP.Conn . . . , 2 pages, (Mar. 29, 2000).

(List continued on next page.)

*Primary Examiner*—Tulsidas Patel
*Assistant Examiner*—Hae Moon Hyeon
(74) *Attorney, Agent, or Firm*—Bradley Forrest; Mark S. Walker

(57) ABSTRACT

An electrical connector has an inner dielectric housing adapted for mounting a plurality of electrical contacts and including at least one forwardly projecting mating portion having opposite sides. The connector has a metallic shield surrounding a major portion of the inner dielectric housing. An outer dielectric cover has a front, a back, a top, a bottom, a first side, and a second side opposite the first side. The outer dielectric cover surrounds a major portion of the metallic shield and includes first and second integrally formed spring latches. The first integrally formed spring latch extends forwardly from the back along the top and the second integrally formed spring latch extending forwardly from the back along the bottom. The first and second spring latches each comprise a spring portion and a distal grip, said distal grips being constructed and arranged to compress the spring latches when a user urges them inwardly toward each other to install the connector in a computer case. When the user releases the grip, the connector is securely held in the computer case by spring biasing provided by the spring latches until a user compresses the spring latch to quickly release the connector from the computer.

21 Claims, 7 Drawing Sheets

OTHER PUBLICATIONS

"Input/Output 2.00mm (.79") IEEE 1394–1995 Shielded I/O Cable Assembly Plug, 6–6 Pin Harness, Latching Type", Molex Incorporated website: http://www.molex.com/scripts/productsea . . . DL=40161&SEQ=1&PRODUCT=592336003&MSEL=N, 1 page, (Mar. 29, 2000).

"Input/Output Universal Serial Bus (USB) Shielded I/O Cable Assembly 'A–to–B' Full–rated, 'A–to–Pigtail' Full–Rated, 'A–to–Pigtail' Sub–Channel", Molex Incorporated website: http://www.molex.com/product/io/88728.html, 2 pages, (Mar. 29, 2000).

"USB Universal Ser. Bus Connectors", Molex Incorporated website: http://www.molex.com/product/io/usb.html, 2 pages, (Mar. 29, 2000).

* cited by examiner

COMPUTER CABLE CONNECTOR PROVIDING QUICK ASSEMBLY AND REMOVAL

FIELD

This invention generally relates to the art of electrical connectors and, particularly, to a shielded electrical connector providing quick assembly and removal of computer cables to a computer case.

BACKGROUND

In computer or communications applications, it is important to shield the signals at a connection interface to prevent the ingress and egress of radiated emissions. Accordingly, shielded connectors have been used at connection interfaces. These connectors have a variety of problems.

First, the shield is difficult to locate and lock onto the connector housing. If the shield is not fixed securely to the underlying housing, a loose fit is created which can result in problems mating the connector to a complementary connecting device, such as to an accessory (e.g., a phone or computer connector) for connecting a peripheral computer device. Peripheral computer devices attached to a computer may include, for example, and not by way of limitation, a mouse or other pointing device, printers, scanners, modems, keyboards, joysticks and game pads, and virtual reality devices such as gloves and visors. These devices are usually physically connected to the computer central processing unit (CPU) box via cables and the like.

Other problems with existing connectors involve structural deficiencies. For example, some shielded input/output (I/O) connectors have open fronts which allow a user to tamper with the interior components of the connector, which can lead to damage or failure of the entire connecting system. In addition, lack of support and/or securement of a circuit substrate within the connector can cause in operation of the system due to breakage or damage of the components.

Still further, in known connector assemblies, some latching mechanisms have been provided which have multiple screws or multiple parts to operate in assembly or removal of a connector to a computer case. Other connectors require separate tools for assembly or removal. These latching mechanisms can be destroyed if excessive force is applied, thus rendering the latching mechanism inoperative.

The present invention is directed to solving one or more of the above myriad of interrelated problems presently occurring in shielded connectors of the character described.

SUMMARY

An object, therefore, of the invention is to provide a new and improved electrical connector, particularly a shielded connector having a latching mechanism integral therewith.

In one embodiment the connector comprises an outer housing having a pair of integrally formed opposing latches which extend forwardly beyond the housing. The latches include a distal gripping portion for a user to compress the latches toward each other to install the connector in a computer. The latching mechanism requires no tools to assemble or remove from the computer.

In one embodiment an electrical connector has an inner dielectric housing adapted for mounting a plurality of electrical contacts and including at least one forwardly projecting mating portion having opposite sides. The connector has a metallic shield surrounding a major portion of the inner dielectric housing. An outer housing or outer dielectric cover has a front, a back, a top, a bottom, a first side, and a second side opposite the first side. The outer dielectric cover surrounds a major portion of the metallic shield and includes first and second integrally formed spring latches. The first integrally formed spring latch extends forwardly from the back along the top and the second integrally formed spring latch extending forwardly from the back along the bottom. The first and second spring latches each comprises a spring portion and a distal grip, each distal grip being constructed and arranged to compress the spring latches when a user urges them inwardly, toward each other to install the connector in a computer case. When the user releases the grip, the connector is securely held in the computer case by spring biasing provided by the spring latch. The connector is removed by gripping and compressing the spring latch while pulling outward on the connector to quickly release the connector from the computer case.

In a further embodiment, the exterior portion of the metallic shield comprises opposite U-shaped indentations. The distal portion of the latches is received by the U-shaped indentations of the metallic shield when the spring latches are compressed.

In one embodiment a cable assembly is provided, the cable assembly being constructed and arranged to be assembled from the outside of the computer case by inserting it in a hole on the case, pushing down until the connector is latched into place, providing a good electromagnetic interference (EMI) ground. This also keeps the cable assembly from being accidentally pushed into the case causing damage to the computer. The cable assembly is removed by pushing the spring latches inward, while pulling outward on the connector. The cable may have a single mating portion or multiple mating portions.

In one embodiment, the present invention provides a method for quick assembly and removal of a computer connector from a computer. In a further embodiment, the present invention provides a method for quick assembly and removal of a computer cable with a connector from a computer.

The connectors and cables of the present invention provide a totally tool-less assembly and method of use.

DESCRIPTION OF EMBODIMENTS

In the following description of sample embodiments, reference is made to the accompanying drawings which form a part hereof, and which are shown by way of illustration specific embodiments in which the invention may be practiced. These embodiments are described in sufficient detail to enable those skilled in the art to practice the invention, and it is to be understood that other embodiments may be utilized and logical, structural, electrical and other changes may be made without departing from the scope of the present invention.

The present invention provides a new and improved electrical connector, particularly a shielded connector having a latching mechanism integral therewith.

Figure 2:
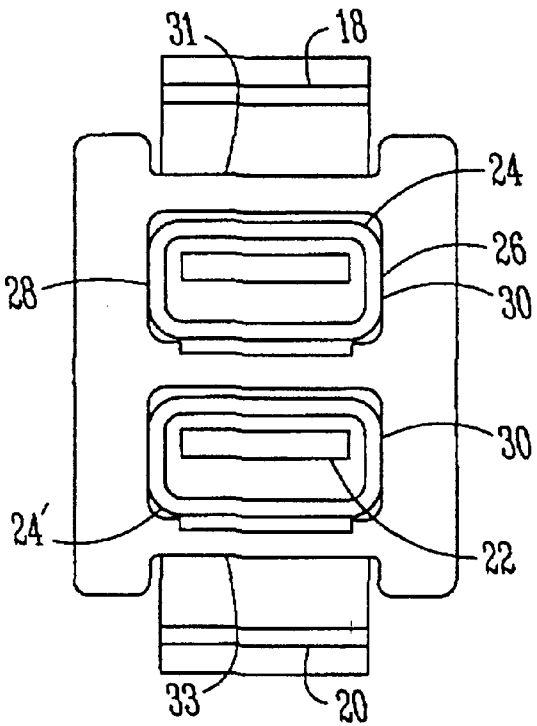
FIG. 2 is a plan view of the front of the electrical connector as in FIG. 1.
Figure 1:
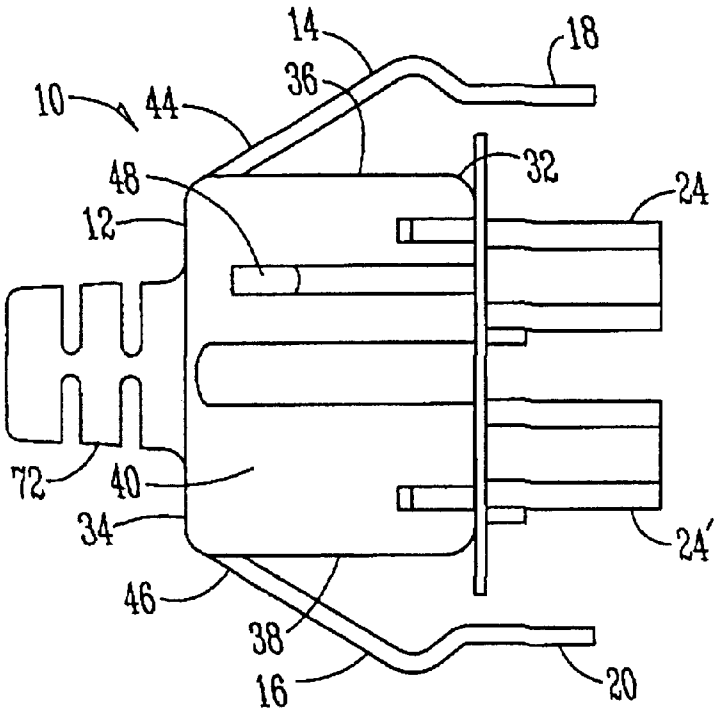
FIG. 1 is a side view of an electrical connector in accordance with the present invention.

Referring primarily to FIGS. 1 and 2, and further to FIGS. 3–6, in one embodiment the connector 10 comprises an outer housing 12 having a pair of integrally formed opposing latches 14, 16 which extend forwardly beyond the outer housing 12, the latches 14, 16 each comprising a distal gripping portion 18, 20 for a user to compress the latches 14, 16 toward each other and against the connector 10 to install the connector 10 in a computer. The latching mechanism 14, 16 provided requires no tools to assemble or remove from the computer. The housing 12 is a one-piece structure unitarily molded of dielectric material such as plastic or the like.

In one embodiment, the connector is an electrical connector 10 having an inner dielectric housing 22 adapted for mounting a plurality of electrical contacts and including at least one forwardly projecting mating portion 24 having opposite sides 26, 28. The connector 10 has a metallic shield 30 surrounding a major portion of the inner dielectric housing 22. Outer housing 12, also referred to as outer dielectric cover 12 has a front 32, a back 34, a top 36, a bottom 38, a first side 40, and a second side 42 opposite the first side 40. The outer dielectric cover 12 surrounds a major portion of the metallic shield 30 and includes first and second integrally formed latches 14, 16 which are also referred to as spring latches 14, 16. The first or upper integrally formed spring latch 14 extends forwardly from the back along the top 36 and the second or lower integrally formed spring latch 16 extends forwardly from the back along the bottom 38 of outer dielectric cover 12. The first and second spring latches 14, 16 each comprise a spring portion 44, 46 and a distal grip 18, 20, said distal grips 18, 20 being constructed and arranged to compress the spring latches 14, 16 when a user urges them inwardly toward the top 36 and bottom 38 to install the connector in a computer case. When the user releases the grip, the connector is securely held in the computer case by spring biasing provided by the spring latches 14, 16 until a user compresses the spring latches 14, 16 to quickly release the connector 10 from the computer case.

In one embodiment, the exterior portion of the metallic shield comprises opposite U-shaped indentations 31, 33. The distal grip 18, 20 of the latches 14, 16 is received by the U-shaped indentations 31, 33 of the metallic shield 30 when the spring latches 14, 16 are compressed.

Figure 5:
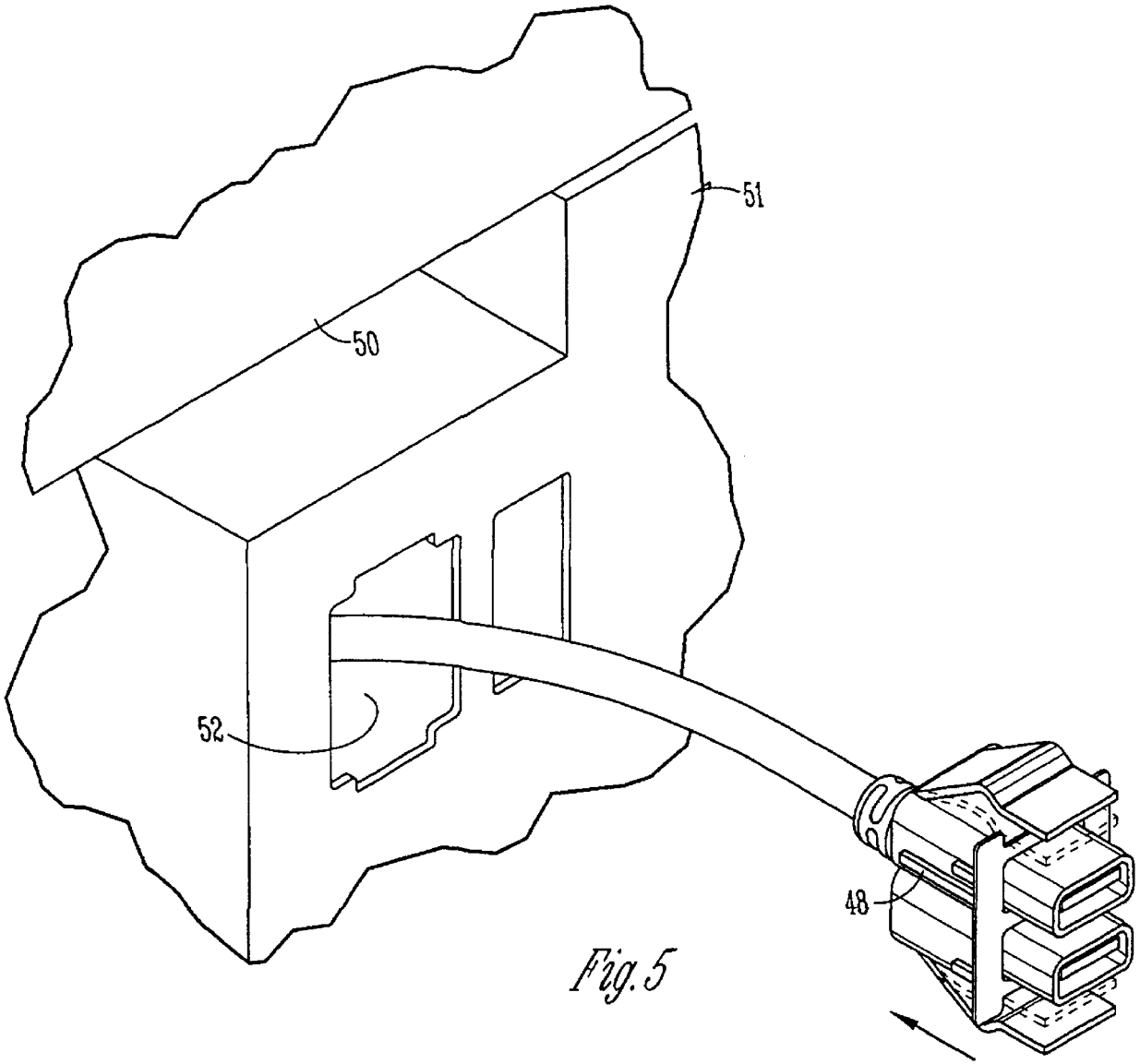
FIG. 5 is a perspective view of the assembly of a cable including an electrical connector in accordance with the present invention being assembled in a computer.
Figure 6:
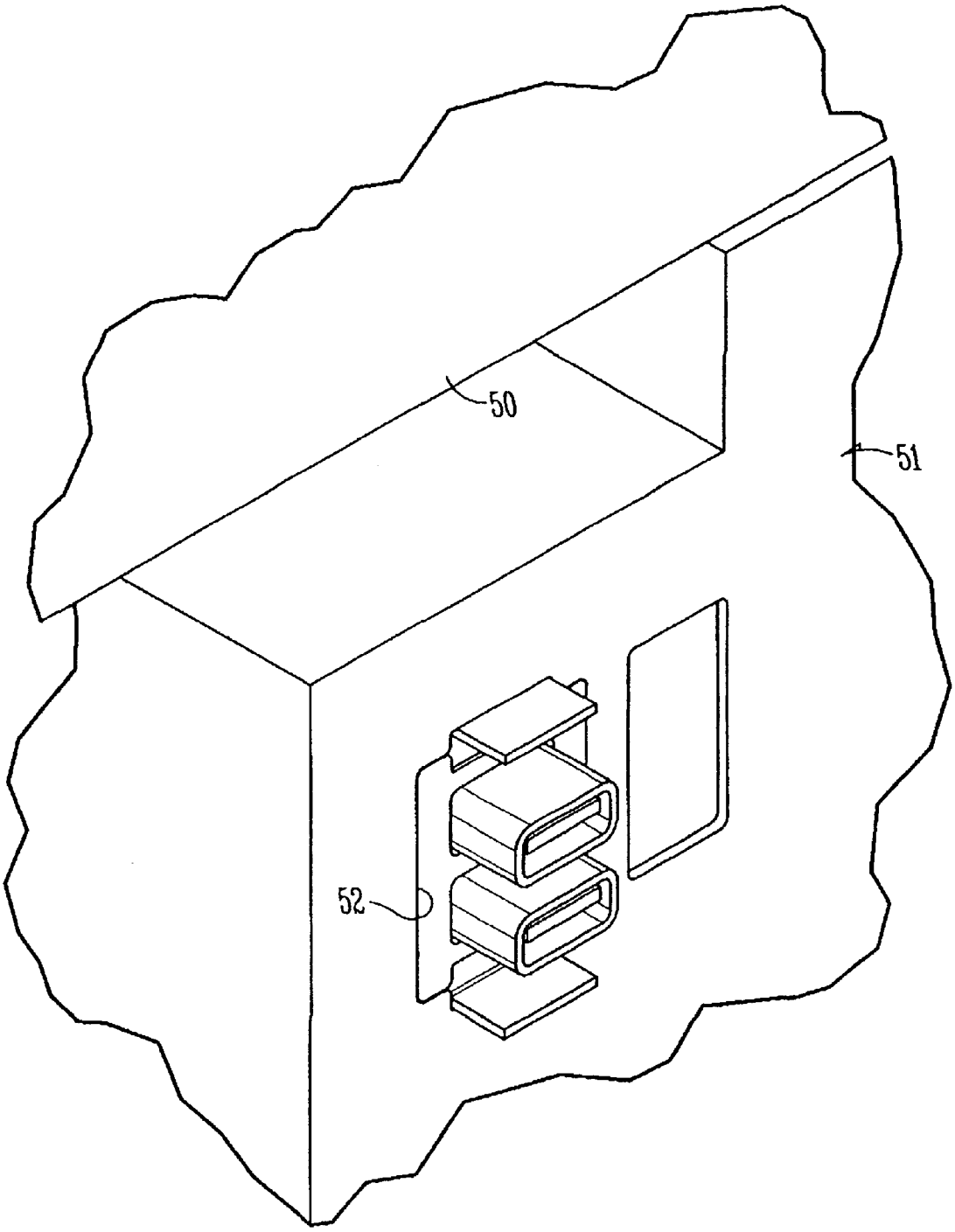
FIG. 6 is a perspective view of the assembly of a cable including an electrical connector in accordance with the present invention being assembled in a computer.

In a further embodiment, as shown at FIGS. 1 and 5, a protrusion or key 48 is formed along the first side 40 to assist in proper placement of the connector 10 in a computer case (shown at 50 in FIGS. 5 and 6).

Figure 7:
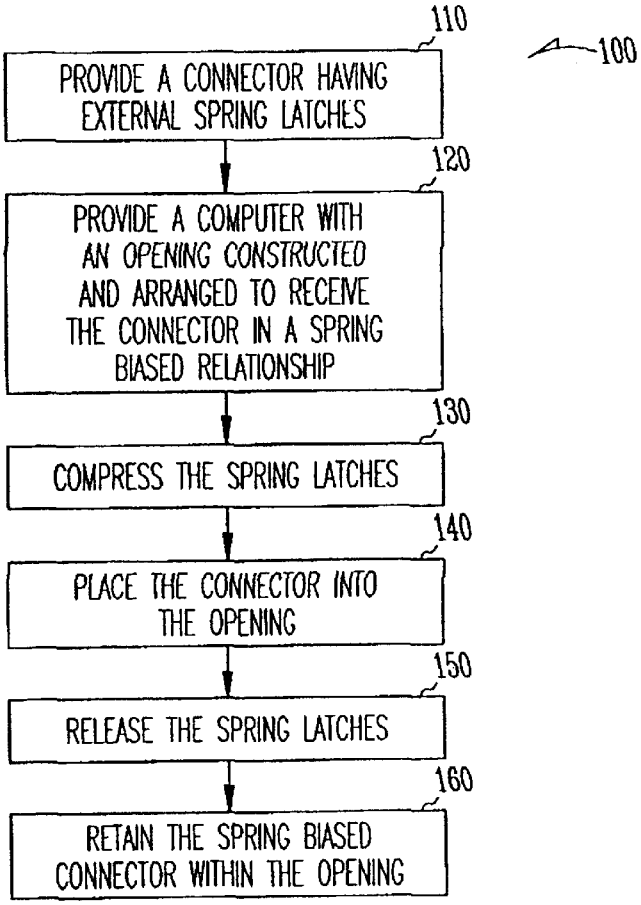
FIG. 7 is a flow chart diagram of a method in accordance with the present invention.
Figure 8:
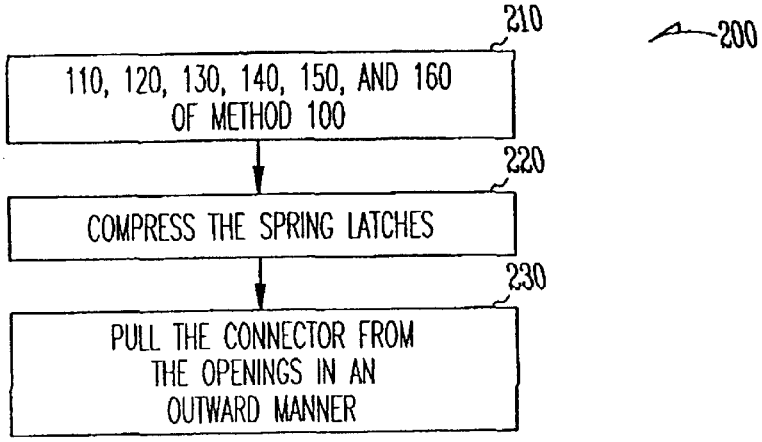
FIG. 8 is a flow chart diagram of a method in accordance with the present invention.

Referring to FIGS. 7–8, in one embodiment the present invention is a method (100) for quick assembly and removal of a connector. The method comprises providing a connector 10 having external spring latches 14, 16 as described herein (110), providing a computer 50 with an opening 52 constructed and arranged to receive connector 10 in a spring biased relationship (120), compressing the spring latches 14, 16 (130), placing the connector 10 into the opening 52 (140), and releasing spring latches 14, 16 (150), whereby the spring biased connector 10 is retained within the opening 52 (160). In one embodiment, a method (200) includes all of the steps of method 100 (210) and further comprises removing the connector 10 from the opening 52 by compressing the spring latches 14, 16 (220) and pulling the connector 10 from the opening 52 in an outward manner (230).

Figure 3:
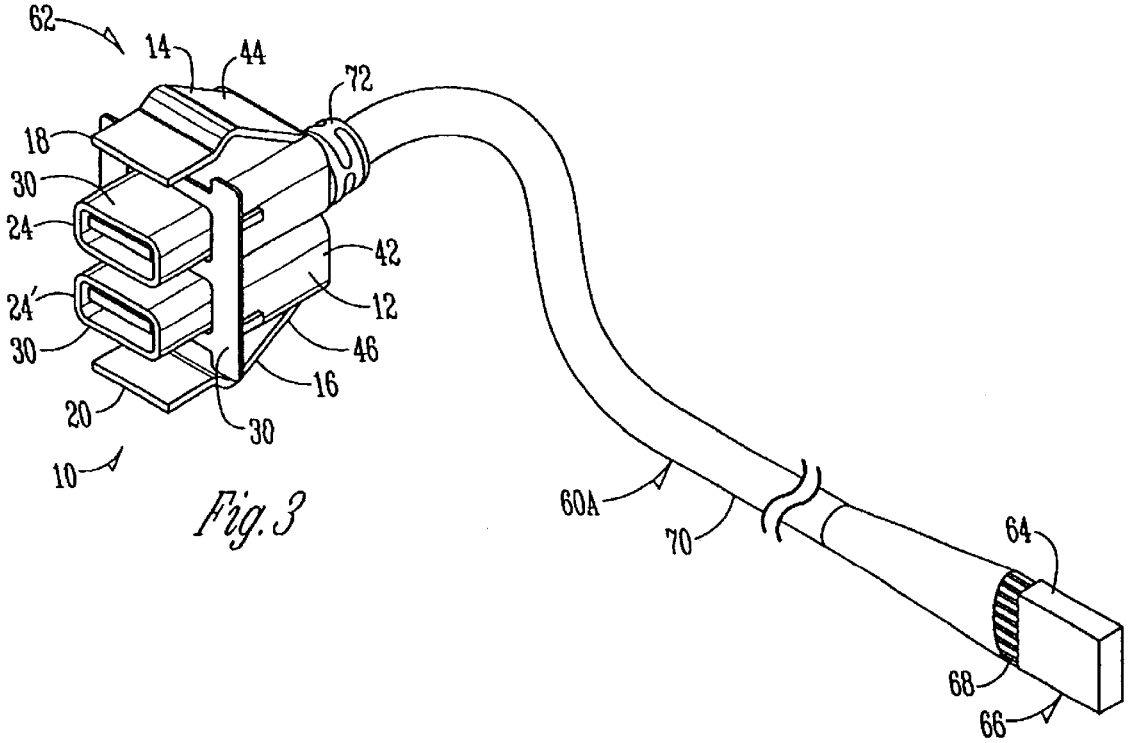
FIG. 3 is a perspective view of a cable including an electrical connector in accordance with the present invention.
Figure 4:
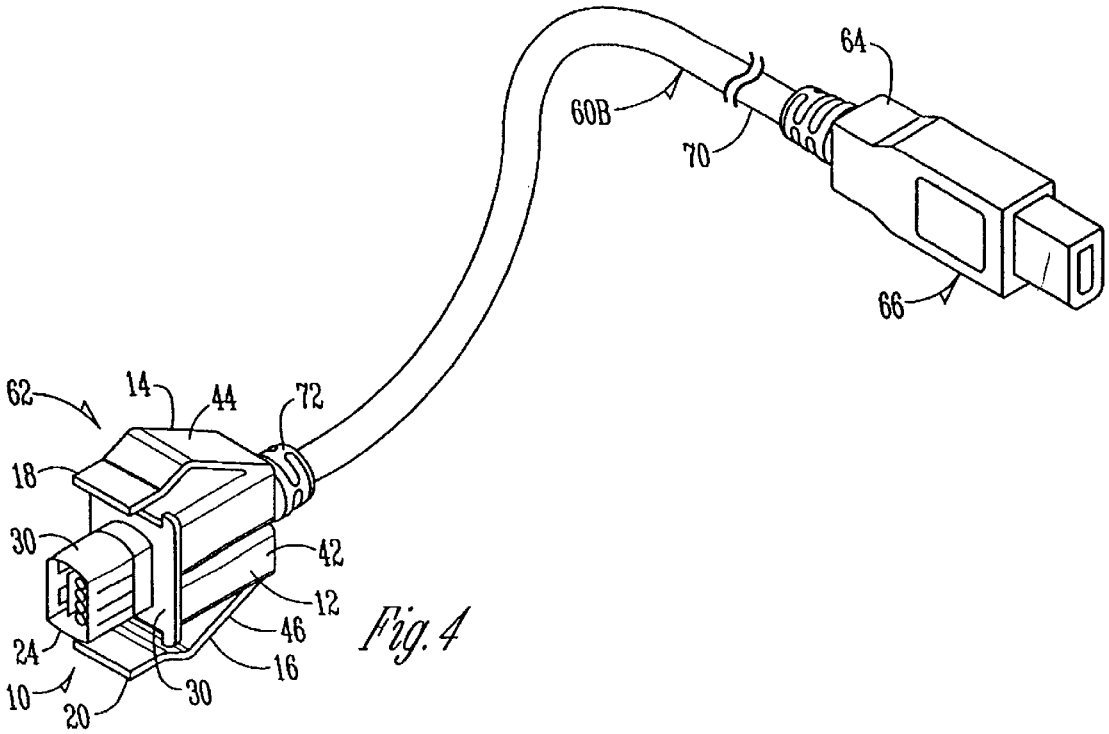
FIG. 4 is a perspective view of a cable including an electrical connector in accordance with the present invention.

Referring to FIGS. 3 and 4, cable assemblies 60A and 60B according to an embodiment of the present invention are shown. The cable assembly 60A shown at FIG. 3 includes a double connector having two outwardly projecting mating portions 24,24' at its proximal end 62. Connector 10 according to the present invention may comprise one connector (mating portion 24 as shown in FIG. 4) or multiple connectors (mating portions), i.e. from 2–8 connectors, or even additional connectors. Further, although a Universal Serial Bus (USB) connector is shown at FIG. 3, the connector 10 may include any interface connector which carries a signal. Nonlimiting examples of such interface connectors are standard connectors, video out connectors, audio connectors, infrared (IR) transceivers, or Institute of Electrical and Electronics Engineers IEEE-1394 (firewire) connectors, all of which may be mounted in a computer according to the present invention.

As such, the cable assemblies 60A and 60B with connector 10 according to the present invention are of particular utility with a computer 50 (as shown in FIG. 5), computer based communications system or a computer based home entertainment system integrating a computer with other home entertainment products such as a television (TV), video cassette recorder (VCR), audio devices, computer peripherals, and the like. For example, integrated personal computer and television systems are known in the art as a "convergence environment" in which a personal computer (PC) is integrated with other devices and capabilities, such as and usually including at least television (TV) capability. Such hardware components are known and available in the art. An example is the Gateway Destination PC/TV system, available from Gateway, Inc., known as the Gateway Destination System. The cable assembly 60A, 60B with connector 10 according to the present invention can also be used to provide cabling to internal components of the computer.

A cable assembly 60A, 60B or connector 10 according to the invention may have one type or multiple connector types (mating portions). For example, the connector 10 may comprise at least one USB connector in addition to at least one IEEE-1394 connector. In one embodiment, connector 10 may comprise a bank of different kinds of connectors. In a further embodiment, connector 10 will emulate the number and type of connectors on the back of the computer case 51 (as shown in. FIG. 5), including serial and parallel ports of the same conductor set, and can thus provide a novel alternative to a standard configuration of computer connectors.

Referring to FIG. 4, in one embodiment the cable assembly 60B comprises a connector 10 providing a single electrical connection. An IEEE-1394 connector is shown, although the connector may be any interface connector which carries a signal. In a further embodiment, the cable assembly has a full length, L of about 24±0.5 inches (609.6±12.7 mm). The weight of the conductor and type of insulator to be used are within the knowledge of one skilled in the art. It will also be generally understood by one skilled in the art that a number of different configurations, conductors, lengths, etc. may be provided for the cable assembly.

Referring to FIGS. 3–6, a connecting plug 64 at the distal end 66 of the cable 70 is insertable into the motherboard (not shown) or other internal component (not shown) of the computer 50. The exposed unshielded wires 68 (as shown in FIG. 3) at the distal end 66 of the cable 70 should be kept to a length of a half inch or less. The outer shield 72 (as shown in FIGS. 3 & 4) of the cable 70 has a 360 degree contact to the connector housing 12. In a further embodiment, the cable assembly 60A as shown at FIG. 3 has a full length, L of about 19±0.5 inches (482.6±12.7 mm). The cable assemblies 60 according to the present invention may be packaged in bulk.

Referring again to FIGS. 5 and 6, cable assembly 60A includes electrical connector 10 according to the present invention. Although cable assembly 60A having two mating portions 24, 24' is shown, the cable assembly may be any cable assembly according to the present invention. The cable assembly 60A is thus constructed and arranged for assembly from the outside of the computer case 51 by inserting them in a hole 52 on the computer case 51 and pushing down or inwardly until they are latched into place, providing good EMI ground. This assembly method and the resulting assembly keeps the cable assembly 60A from being accidentally pushed into the case 50 causing damage to the computer. Cable assembly 60A can be removed by pushing the plastic spring latches inward, while pulling outward on the connector. The present invention further contemplates a computer system including a computer case 51 with the opening 52 already punched out for receiving cable assembly 60A and retaining connector 10 therein. In addition, the present invention contemplates providing an opening 52 by punching out an area of the computer case 51, punching out a piece of plastic and metal gasket which are normally seals for EMI, pushing the cable through and latching the connector 10 into the opening 52, whereby the connector 10 is spring biased and held in opening 52.

In a further alternative embodiment, a PC card could be connected to a motherboard by a connector 10 according to the present invention as described herein. Nonlimiting examples are computer systems and cards using a USB with a connector 10 according to the present invention utilized completely internal to a computer.

Figure 9:
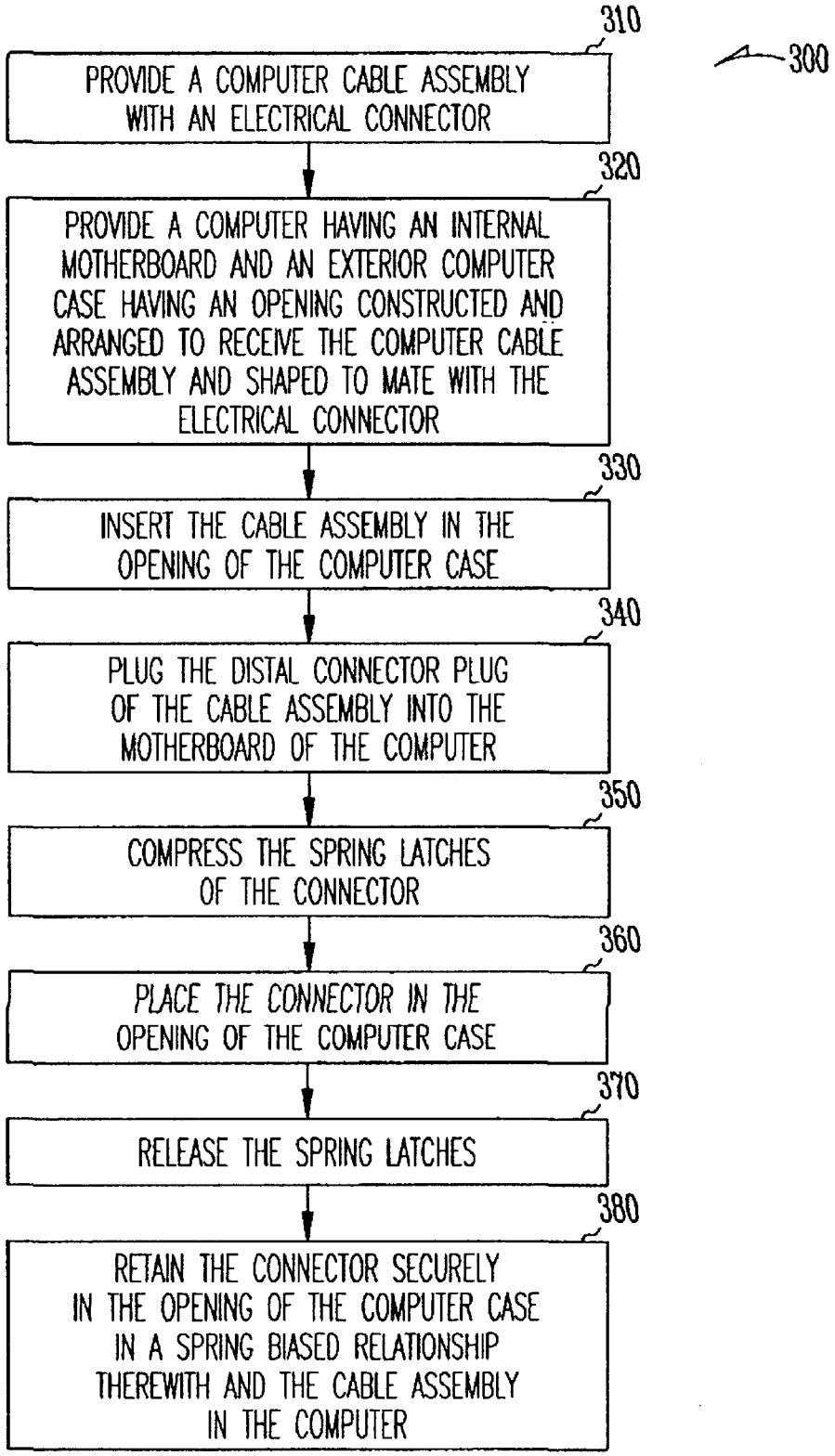
FIG. 9 is a flow chart diagram of a method in accordance with the present invention.
Figure 10:
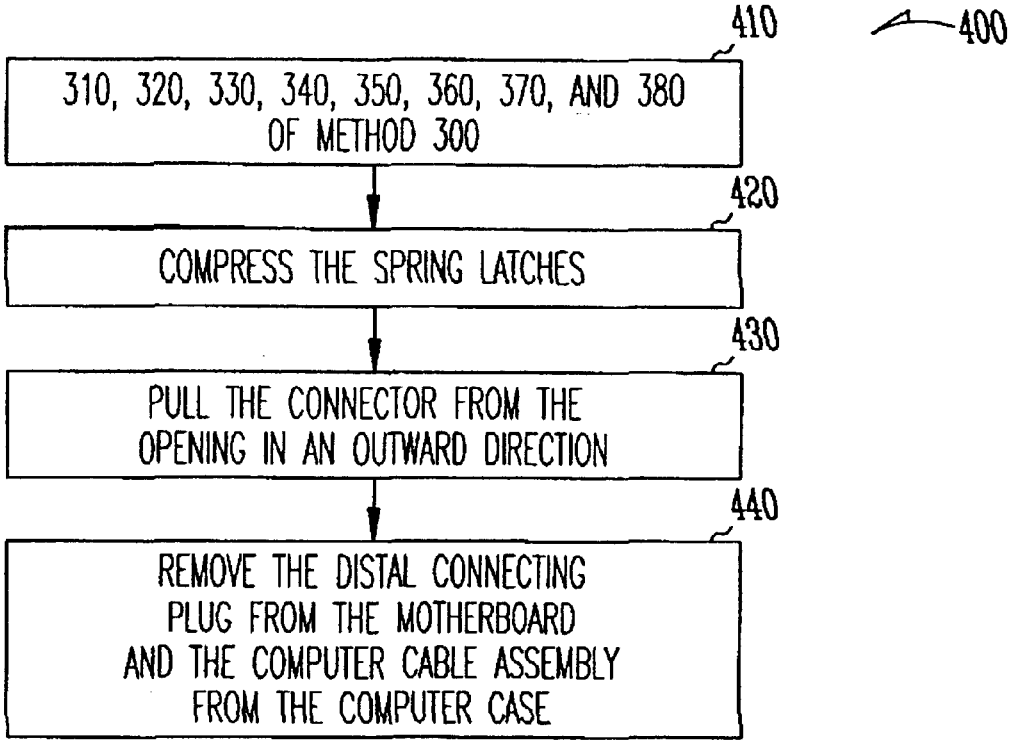
FIG. 10 is a flow chart diagram of a method in accordance with the present invention.

Referring now to FIGS. 9–10, in one embodiment, the present invention provides a method (300) for quick assembly and removal of a computer cable connector assembly 60 to a computer. The method includes providing a computer cable assembly 60 with an electrical connector 10 according to the present invention (310) and a computer 50 having an internal motherboard and an exterior computer case 51 (320). The exterior computer case 51 has an opening 52 constructed and arranged to receive the computer cable assembly 60 and shaped to mate with the electrical connector 10. The computer cable assembly 60 is inserted in the opening 52 of the computer case 51 (330). The distal connector plug 64 is plugged into the motherboard of the computer 50 (340). The spring latches 14, 16 of the connector 10 are compressed (350). The connector 10 is placed in the opening 52 of the computer case 51 (360) and the spring latches 14, 16 are released (370). The connector 10 is retained securely in the opening 52 of the computer case 51 in a spring biased relationship therewith and the cable assembly 60 is thus retained in the computer 50 (380). In a further embodiment, the method (400) includes all of the steps of method 300 (410) and further comprises removing the cable assembly 60 from the computer 50 by removing the connector 10 from the opening 52 in the computer case 51 by compressing the spring latches 14, 16 (420), pulling the connector 10 from the opening 52 in an outward direction (430), and removing the distal connecting plug 64 from the motherboard and the computer cable assembly 60 from the computer case 51 (430).

Advantages provided by the connector of the present invention are many. The connector provides access to mounting latches from the exterior of a system as opposed to the interior. Most computer systems with exterior connectors connect by a card or daughter board with a connector. The present invention provides a direct interface from most exterior portable devices or peripherals to the motherboard. The possible devices which may be connected from the board directly to the system, or in the case of audio out, to a daughter board. The connector provides a connection into the computer chassis providing sufficient EMI shielding.

A user at home can reconfigure a computer with the cables having the inventive connectors. Customer support staff can easily assist the user. The connector provides simple, toolless reconfigurability. The connector with the spring latches provides easy installation and removal with no tools. The distal portion of the cable is pushed through the hole in the computer case and threaded into the system. The distal portion can be connected to the motherboard or other internal component of the computer. The connector nests and fits snugly into the hole to the exterior of the computer to provide sufficient ground or EMI sealing. The connector is removed by compressing the spring latches and pulling outwardly, thereby removing the distal portion of the cable from its connection to the motherboard. In one embodiment, the connector provides gasketing for the hole in which it is mounted.

Accordingly, in one embodiment the present invention is an electrical connector (10) including an inner dielectric housing (22), a metallic shield (30) and an outer housing or dielectric cover (12). The inner dielectric housing (22) is adapted for mounting a plurality of electrical contacts and includes at least one forwardly projecting mating portion (24) having opposite sides (26, 28). The metallic shield (30) surrounds a major portion of the inner dielectric housing (22). The outer housing or dielectric cover (12) has a front (32), a back (34), a top (36), a bottom (38),;a first side (40), and a second side (42) opposite the first side (40). The outer housing (12) surrounds a major portion of the metallic shield (30) and further includes a first integrally formed spring latch (14) and a second integrally formed spring latch (16), the integrally formed spring latches extending forwardly beyond the front (32) of the outer housing (12).

In one embodiment the first integrally formed spring latch (14) extends forwardly from the back (34) along the top (36) and the second integrally formed spring latch (16) extends forwardly from the back (34) along the bottom (38). The first spring latch (14) and the second spring latch (16) each have a spring portion (44,46) and a distal grip (18, 20). The distal grips (18, 20) are constructed and arranged to compress the spring latches (14, 16) when a user urges the grips (18, 20) inwardly toward each other.

The outer housing (12) is constructed and arranged to mate with an opening (52) in a computer case (50), the connector (10) being securely and removably mounted in the computer case (50) by the spring biased spring latches (14,

16). The connector (10) is removed by the user upon compression of the spring latches.(14, 16), whereby the connector (10) is quickly released from the computer case (50).

In one embodiment, the metallic shield (30) has a first U-shaped indentation (31) and a second U-shaped indentation (33) shaped to respectively receive the first spring latch (14) and the second spring latch (16) when a user compresses the spring latches (14, 16) to remove the connector (10) from a computer case (50).

The forwardly projecting mating portion (24) is any interface connector which carries a signal. In one embodiment the forwardly projecting mating portion (24) is a USB connector. In a further embodiment, the forwardly projecting mating portion (24) is a IEEE-1394 (firewire) connector. In yet another embodiment, the electrical connector (10) includes at least one additional forwardly projecting mating portion (24').

In one embodiment, the present invention is a cable assembly (60A, 60B) providing a digital interface for a computer system. The cable assembly (60A, 60B) includes a cable (70) having a proximal end (62) and a distal end (66). An electrical connector (10) according to the present invention is operably coupled with the cable (70) and located at the proximal end (62) of the cable (70). A connecting plug (64) is operably coupled with the cable (70) and located at its distal end (66). The connecting plug (64) is insertable into a motherboard (not shown) or other internal component (not shown) of a computer (50).

In one embodiment the present invention is a method (100) for quick assembly and removal of a connector to a computer. The method (100) comprises providing a connector having external spring latches as described herein (110), providing a computer with an opening constructed and arranged to receive connector in a spring biased relationship (120), compressing the spring latches (130), placing the connector into the opening (140), and releasing spring latches (150), whereby the spring biased connector is retained within the opening (160). In one embodiment, the method (200) includes method (100) and further comprises removing the connector from the opening by compressing the spring latches (220) and pulling the connector from the opening in an outward manner (230).

In one embodiment, the present invention provides a method (300) for quick assembly and removal of a computer cable connector assembly to a computer. The method includes providing a computer cable with an electrical connector according to the present invention (310) and a computer having an internal component such as a motherboard and an exterior computer case (320). The exterior computer case has an opening constructed and arranged to receive the computer cable assembly and shaped to mate with the electrical connector. The computer cable assembly is inserted in the opening of the computer case (330). The distal connector plug is plugged into the motherboard or other internal component of the computer (340). The spring latches of the connector are compressed (350). The connector is placed in the opening of the computer case (360) and the spring latches are released (370). The connector is retained securely in the opening of the computer case in a spring biased relationship therewith and the cable assembly is thus retained in the computer (380). In a further embodiment, the method (400) includes method (300) and further comprises removing the cable assembly from the computer by removing the connector from the opening in the computer case by compressing the spring latches (420), pulling the connector from the opening in an outward direction (430), and removing the distal connecting plug from the motherboard or other internal component, and the computer cable assembly from the computer case (440).

It will be understood that the invention may be embodied in other specific forms without departing from the scope or central characteristics thereof. The present examples and embodiments, therefore, are to be considered in all respects as illustrative and not restrictive, and the invention is not to be limited to the details given herein.

Although specific embodiments have been illustrated and described herein, it will be appreciated by those of ordinary skill in the art that any arrangement which is calculated to achieve the same purpose may be substituted for the specific embodiments shown. This application is intended to cover any adaptations or variations of the invention. It is intended that the invention be limited only by the following claims, and full scope of equivalents thereof.

What is claimed is:

1. An electrical, comprising:

a inner dielectric housing adapted for mounting a plurality of electrical contacts and including at least one forwardly projecting mating portion having opposite sides;

a metallic shield surrounding a major portion of the inner dielectric housing, a portion of which is transverse to the forwardly projecting mating portion; and an outer housing comprising an outer dielectric cover having a front, a back, a top, a bottom, a first side, and a second side opposite the first side, the outer dielectric cover surrounding a major portion of the metallic shield and filer including a first integrally formed spring latch and a second integrally formed spring latch, the integrally formed spring latches extending forwardly beyond the front of the outer dielectric cover.

2. The electrical connector of claim 1 wherein the first integrally formed spring latch extends forwardly from the back along the top and the second integrally formed spring latch extends forwardly from the back along the bottom, the first spring latch and the second spring latch each comprising a spring portion and a distal grip, said distal grips being constructed and arranged to compress the spring latches when a user urges the grips inwardly toward each other.

3. The electrical connector of claim 2 wherein the outer housing is constructed and arranged to mate with au opening in a computer case, the connector being securely and removably mounted in the computer case by the spring biased spring latches, the connector being removable by the user upon compression of the spring latches, whereby the connector is quickly released from the computer case.

4. The electrical connector of claim 1 wherein the portion of the metallic shield which is transverse to the forwardly projecting mating portion, further comprises a first U-shaped indentation and a second U-shaped indentation shaped to respectively receive the first spring latch and the second spring latch when a user actuates the spring latches to remove the connector from a computer case.

5. The electrical connector of claim 1 wherein the forwardly projecting mating portion is any interface connector which carries a signal.

6. The electrical connector of claim 5 wherein the forwardly projecting mating portion is a USB connector.

7. The electrical connector of claim 5 wherein the forwardly projecting mating portion is a EEBE-1394 (firewire) connector.

8. The electrical connector of claim 5 including at lent one additional forwardly projecting mating portion.

9. A cable assembly providing an interface for a computer system, the cable assembly comprising:

an electrical connector operably coupled with the cable and located at the proximal end thereof, the electrical connector comprising an inner dielectric housing adapted for mounting a plurality of electrical contacts and including at least one forwardly projecting mating portion, a metallic shield surrounding a major portion of the inner dielectric housing, a portion of which is transverse to the forwardly projecting mating portion, an outer dielectric cover having a front, a back, a top, a bottom, a first side, and a second side opposite the first side, the outer dielectric cover further including a first integrally formed spring latch and a second integrally formed spring latch, the integrally formed spring latches extending forwardly beyond the front of the outer dielectric cover; and a connecting plug operably coupled with the cable and located at the distal end thereof, the connecting plug insertable into a motherboard of a computer.

10. The cable assembly of claim 9 wherein the connector further comprises:

an inner dielectric housing adapted for mounting at least one electrical contact and including at least one forwardly projecting mating portion having opposite sides; and a metallic shield surrounding a major portion of the inner dielectric housing.

11. The cable assembly of claim 10 wherein the first integrally formed spring latch extends forwardly from the back along the top and the second integrally formed spring latch extends forwardly from the back along the bottom, the first spring latch and the second spring latch each comprising a spring portion and a distal grip, said distal grips being constructed and arranged to compress the spring latches when a user urges the grips inwardly toward each other.

12. The cable assembly of claim 11 wherein the housing is constructed and arranged to mate with an opening in a computer case, the connector being securely and removably mounted in the computer case by the spring biased spring latches, the connector being removable by the user upon compression of the spring latches, whereby the connector is quickly released from the computer case.

13. The cable assembly of claim 12 wherein the metallic shield further comprises a first U-shaped indentation and a second U-shaped indentation shaped to respectively receive the first spring latch and the second spring latch when a user actuates the spring latches to remove the connector from a computer case.

14. The cable assembly of claim 10 wherein the forwardly projecting mating portion is any interface connector which caries a signal.

15. The cable assembly of claim 14 wherein the forwardly projecting mating portion is a USB connector.

16. The cable assembly of claim 14 wherein the forwardly projecting mating portion is a IBEE-1394 (finds) connector.

17. The cable assembly of claim 10 wherein the connector further comprises at least one additional forwardly projecting mating portion.

18. A method for quick assembly and removal of a connector to a computer case, the method comprising:

providing the connector comprising an outer dielectric cover having a front, a back, a top, a bottom, a first side, and a second side opposite the first side, the outer dielectric cover further including a first integrally formed spring latch and a second integrally formed spring latch, the integrally formed spring latches extending forwardly beyond the front of the outer dielectric cover;

providing a computer with an opening constructed on the computer case and arranged to receive the connector;

compressing the spring latches;

placing the connector into the opening of the computer; and releasing the spring latches, whereby the connector is retained within the opening of the computer in a spring biased relationship therewith.

19. The method of claim 18 further comprising:

removing the connector from the opening of the computer by compressing the spring latches and pulling the connector from the opening in an outward direction.

20. A method for quick assembly and removal of a computer cable connector assembly to a computer, the method comprising:

providing a computer cable assembly comprising:

a cable having a proximal end and a distal end;

an electrical connector operably coupled with the cable and located at the proximal end thereof the electrical connector comprising an outer dielectric cover having a front, a back, a top, a bottom, a first side, and a second side opposite the first side, the outer dielectric cover further including a first integrally formed spring latch and a second integrally formed spring latch the integrally formed latches extending forwardly beyond the front of the outer dielectric cover, and a connecting plug operably coupled with the cable and located at the distal end thereof, the connecting plug insertable into a motherboard of a computer;

providing the compute having the motherboard located internally and an exterior computer case, the exterior computer case having an opening constructed and arranged to receive the computer cable assembly and shaped to mate with the electrical connector thereof;

inserting the computer cable assembly into the opening of the computer case;

plugging the distal connector plug into the motherboard of the computer;

compressing the spring latches of the computer connector;

placing the computer connector into the opening of the computer case; and releasing the spring latches, whereby the connector is retained within the opening of the computer case in a spring biased relationship therewith.

21. The method of claim 20 further comprising:

removing the connector from the opening of the computer by compressing the spring latches and pulling the connector from the opening in an outward direction, thereby removing the distal connecting plug from the motherboard and the computer cable assembly from the computer case.

* * * * *